US005226649A

United States Patent [19]

Beirne, Jr. et al.

[11] Patent Number: 5,226,649

[45] Date of Patent: Jul. 13, 1993

[54] BOWLING ALLEY GUTTER AND MOUNTING CLIPS

[75] Inventors: D. Peter Beirne, Jr., Westerville; Tony Potenza, Galloway, both of Ohio

[73] Assignee: Winchester Fabricators, Inc., Columbus, Ohio

[21] Appl. No.: 874,119

[22] Filed: Apr. 24, 1992

[51] Int. Cl.[5] ..... A63D 1/08

[52] U.S. Cl. ..... 273/51

[58] Field of Search ..... 273/51

[56] References Cited

U.S. PATENT DOCUMENTS

| | | | |
|---|---|---|---|
| 2,971,759 | 2/1961 | Blatt | 273/51 |
| 3,186,712 | 6/1965 | Kessler | 273/51 |
| 3,279,795 | 10/1966 | Larson | 273/51 |
| 4,801,743 | 1/1989 | Heddon | 273/51 |

*Primary Examiner*—V. Millin
*Assistant Examiner*—William M. Pierce
*Attorney, Agent, or Firm*—George Wolken, Jr.

[57] ABSTRACT

The present invention comprises a gutter channel for bowling alleys. In particular, the present invention comprises a bowling alley gutter having a symmetric cross-section. The symmetric cross-section leads to both left and right gutters being identical, eliminating the possibility of misinstalled gutters. The bowling alley gutter of the present invention comprises a structure having a shape similar to a segment of a cylinder subtending an arc of approximately 117 degrees with a circular radius of approximately 5.625 inches. At the terminating ends of such circular arc, acute angular bends, approximately 29 degrees and 0.375 inches in length, directed away from the center of said cylinder, have been placed. Metal having a vinyl coating securely laminated thereto is a convenient material for the gutter of the present invention. The present invention also relates to a design for mounting clips for such a bowling alley gutter allowing particularly efficient installation and replacement.

3 Claims, 2 Drawing Sheets

BOWLING ALLEY GUTTER AND MOUNTING CLIPS

BACKGROUND OF INVENTION

This invention relates generally to the field of recreation and sports equipment; and more particularly, the present invention relates to designs for bowling alley gutters.

The American Bowling Congress reports that, as of 1988, there were 7,923 bowling establishments in the United States comprising some 150,000 bowling lanes. The number of bowling establishments and bowling lanes worldwide is certainly several times these values. Thus, bowling is a popular recreational activity, in the US and around the world.

The typical bowling alley will be used by bowlers having all levels of skill from highly expert to novices. Indeed, one of the attractions of bowling as a recreational activity is the ability of all levels of skilled participants (including young children) to take part in the activity simultaneously.

However, players of all skill levels will occasionally launch a bowling ball at the pins in such an imprecise fashion that the ball will leave the alley before impacting the pins. This is much more common, certainly, among novice bowlers frequently found in family bowling establishments. Such "gutter balls" plunge into a special channel adjacent to the alley, the gutter, and are carried to the region below and behind the pins for return to the bowler for another attempt. Such gutters are placed on either side of the bowling alley to receive errant balls and should not be confused with a separate channel (typically under the lane) which is used to return the ball to the bowler. The gutter must withstand the impact of a heavy bowling ball, often up to 16 lbs in weight, falling from the alley or rolling into the gutter with some velocity of its own. In any case, the impact of the bowling ball on the gutter will gradually cause distortion and impact damage. The ball return channel is not subject to such impacts and, consequently, has a longer service lifetime.

The gutter must be sufficiently hard and rigid to withstand impact by the bowling ball, but must also be sufficiently soft and yielding so as not to cause damage to the bowling ball itself. To balance these opposing needs, older bowling alleys often used wooden structures for gutters. However, as a relatively soft material, wood did not withstand the impact of gutter balls for long before dents, chips and other damage occurred, requiring refinishing or replacement. To avoid the need for frequent repair or replacement to wooden gutters, other materials were sought. At present, a common choice for gutters is to make them of metal. While metal gutters provide improved service life, a plastic lamination is typically used (commonly a vinyl) to provide a softer surface for the bowling ball to impact. Such vinyl coated metal gutters are very common in modern bowling alleys.

Under normal usage, even vinyl coated metal gutters require replacement. Typically, the lifetime of such a bowling alley gutter would be about 10 years of normal use in a commercial bowling establishments. Thus, each year in the US, about 15,000 bowling lanes (2 gutters each) are candidates for replacement, and several times this number are replaced around the world. The design of a bowling alley gutter which simplifies the problem of replacement is an important object of the present invention.

Effective bowling alley gutters must meet several requirements. Many bowlers (more common among expert bowlers) throw the bowling ball toward the pins with a pronounced curve in the trajectory. Such a "hook" is preferred by expert bowlers since the bowling ball impacts the pins at an angle not precisely parallel to the long axis of the bowling lane, and the ball proceeds through the region of the pins continuing to follow its curved trajectory. It is thought that such an impact angle and trajectory causes the pins to fly about in such a way (pin "action") as to increase the probability that pins will topple each other. However, such curved trajectories often come very near the edge of the bowling lane before curving inward towards the pins. Indeed, it is not uncommon for such hooked rolls of the bowling ball to overhang the edge of the lane before curving inward and striking the pins in a completely acceptable manner. Thus, the first requirement for a bowling alley gutter is that it be recessed below the horizontal level of the lane so as not to interfere with bowlers throwing such "hooks" in an otherwise acceptable bowling technique. (The situation might be different if the only balls overhanging the gutter are those headed for the gutter and scoring oblivion anyway. However, this is not the case.)

Thus, the gutter is commonly recessed below the level of the lane on the side of the gutter closest to the lane. On the opposite side of the gutter, away from the lane ("cap side"), no such requirement exists. It is prudent to make the gutter much higher on the cap side so as to effectively catch badly misthrown balls, preventing them from overshooting the gutter and interfering with the play of adjacent lanes. Prior to the present invention, bowling alley gutters typically were designed with an asymmetrical cross-sectional shape, the lane side having a different geometry from that of the cap side.

Vinyl coated metal gutters are typically fabricated in lengths convenient for shipping; significantly less than the length of the entire bowling alley. Thus, the installers must fit several pieces together in order to fully construct a bowling alley gutter for the entire length of the lane. However, when the bowling ball rolls over a joint (on its way to the pin region for return), no protrusions can be present. Such protrusions of coated metal are easily capable of damaging the bowling ball, much to the distress of the bowlers who frequently use their own custom-made bowling balls. Thus, the present practice typically has the joint regions overlapped, such that as the bowling ball rolls down the gutter toward the pin region, it goes from a higher level to a lower level at each gutter joint.

Thus, the lane side of the gutter is typically different from the cap side of the gutter. At the joint sections, the side nearer the bowler overlaps the side nearer the pins so the bowling ball always rolls downhill. These two requirements have led present bowling alley gutters to be fabricated in a "left" and a "right" version. That is, gutters come in sets like gloves in which the gutter for the left side of the alley has a different, mirror image, construction from the gutter for the right side of the alley. If installers were perfect, reading, understanding and carefully following all instructions, such left-right differences would not be a problem. Unfortunately, in the real world installers frequently do not carefully follow instructions; may not understand instructions in english, or indeed, may not be literate at all. A complication for left and right gutters (not shared with gloves in a pair) consists in the fact that it is far from obvious in a casual inspection which is left and which is right. It has become a significant expense for manufacturers to send technicians around the globe to repair and correct misinstalled bowling alley gutters. Therefore, it is a major object of the present invention to have a bowling alley gutter fully symmetrical in cross-section, with no difference from left and right gutters. This simplifies the installation of such gutters, reduces the opportunities for misinstallation, and consequently reduces the expense of repair and reinstallation.

The combination of the fully symmetrical gutter of the present invention along with specially designed mounting clips, allows a particularly rapid and efficient installation of the present gutter, as fully described below.

SUMMARY AND OBJECTS OF THE INVENTION

The present invention relates to gutter channels for bowling alleys. In particular, the present invention relates to a bowling alley gutter having a symmetric cross-section. The symmetric cross-section leads to both left and right gutters being identical, eliminating the possibility of misinstalled gutters. The present invention provides a vinyl coated metal gutter of particularly simple design for fabrication and installation.

A primary object of the present invention is to provide a bowling alley gutter of symmetrical cross-section.

Another object of the present invention is to provide a bowling alley gutter in which there is no structural difference between left and right gutters.

Another object of the present invention is to provide a vinyl coated metal bowling alley gutter of simple design and simplified installation with reduced possibilities for misinstallation.

Yet another object of the present invention is to provide a combination of bowling alley gutter and mounting clips such that removal and installation of gutters is relatively simple.

DESCRIPTION OF PREFERRED EMBODIMENTS

The present invention consists of a symmetrical bowling alley gutter, designed with a fully symmetrical shape for ease of installation and replacement by unskilled or semiskilled workers around the world. The present invention also consists of special clips for use in combination with the symmetrical bowling alley gutter to facilitate efficient removal and installation of such gutters.

Figure 1:
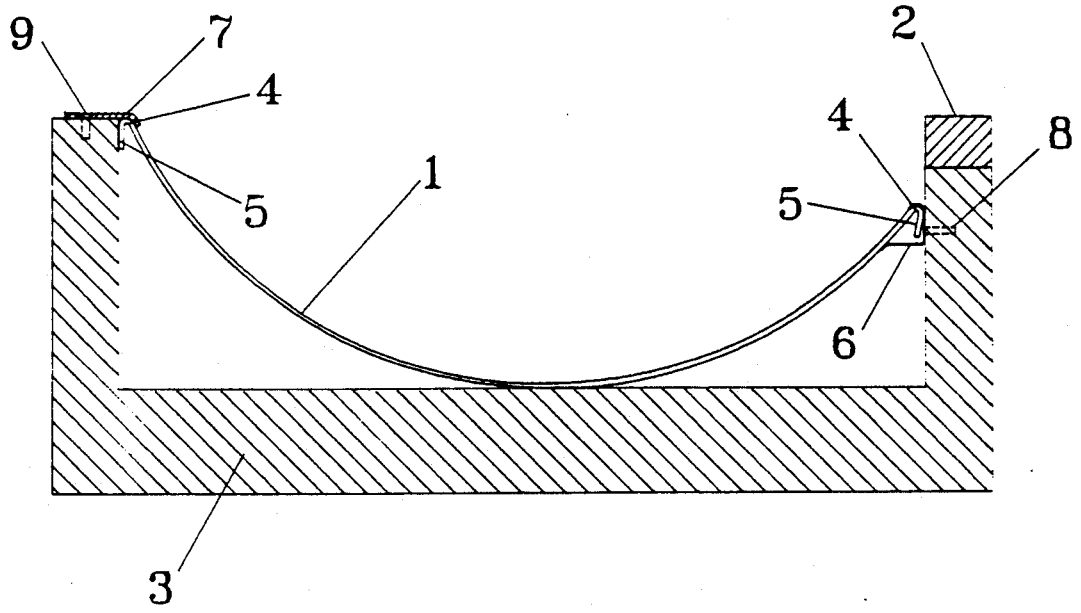
FIG. 1. A cross-sectional view of a bowling alley gutter after the present invention, as would typically be placed into the framing space next to the bowling alley. The clips used in fastening the gutter to the frame are also shown in cross-sectional view.

FIG. 1 shows a cross-sectional view of a typical gutter according to the present invention, 1, as would be installed into the framing structure, 3, adjacent to the bowling lane. Typically, the surface used for bowling, 2, would consist of a hardwood material, typically installed in a configuration of many narrow boards. Being relatively expensive, this bowling surface, 2, would be mounted on a cheaper framing material (typically lower quality wood). This framing structure would typically be constructed in the "U" shape shown in FIG. 1 to hold the gutter into position. FIG. 1 shows only one gutter adjacent to the left side of the alley (when viewed from the perspective of the bowler). The bowling surface of the lane, 2, extends to the right of FIG. 1 and ends in a gutter configuration the mirror image of that shown in FIG. 1. The full width of the bowling surface, 2 and the second, mirror image, gutter configuration are not shown.

As shown in FIG. 1, the gutter of the present invention, 1, has a shape essentially that of an arc of a circle. For typical bowling alley and framing structure geometries, the circular arc subtends an angle approximately 117.3 degrees in a circular arc wherein the circle has a radius of curvature of approximately 5.625 inches.

The gutter of the present invention has symmetrical, u-shaped mounting structures, 4, on each end thereof, fabricated as a single piece along with the fabrication of the gutter, 1. Such mounting structures, 4, are mirror images of each other about the midplane of the gutter, 1, retaining thereby the fully symmetric geometry of the present invention. The mounting structures, 4, typically subtend an angle of approximately 29 degrees at the open end thereof.

When mounted into the framing structure, 3, adjacent to the bowling lane, the gutter of the present invention would be rotated such that: 1) the edge nearer the bowling surface, 2, is well receded below the level of the bowling surface, avoiding thereby any possibility of interference with an overhanging bowling ball; and 2) mounting structures, 4, would have the outside edge thereof, 5, in a vertical position, making thereby a snug fit with the interior of the framing structure, 3.

Figure 2:
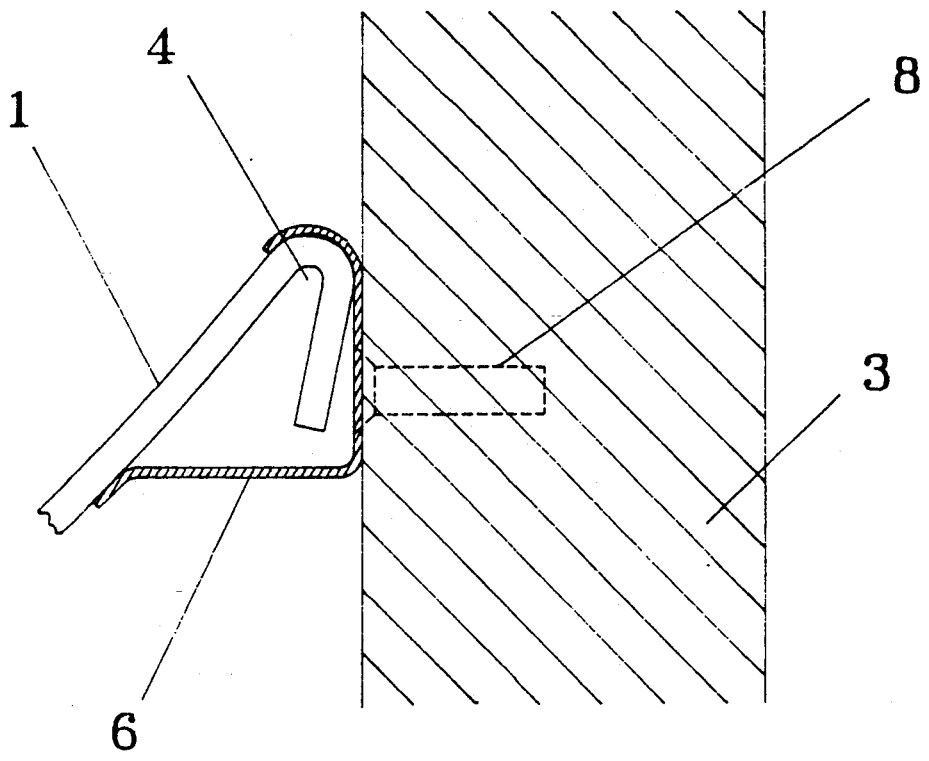
FIG. 2. A cross-sectional, enlarged, view of a typical means for fastening the bowling alley gutter of the present invention to the lane side of the framing space.

FIG. 2 shows an enlarged view of the mounting structure, 4 as it is typically attached to the framing structure, 3, in practicing the present invention. Typically, a metal clip, 6, is employed having substantially the cross-section shown in FIG. 2, and having a length typically 2.75 inches in the direction perpendicular to the plane of FIG. 2. Typically, mounting clip, 6, would be nailed or screwed to the framing structure (typically having holes therein, 8, for such purpose), 3, on the lane side of said framing structure in locations substantially suited for attaching the bowling alley gutter substantially as shown in FIG. 1. The positioning of mounting clips, 6, would be performed initially upon installation. Typically, as bowling alley gutters require replacement, the mounting clips, 6, would not need to be repositioned. They may need to be renailed or rescrewed if loosened during service. However, the relatively more complex task of repositioning mounting clips, 6, would not typically be required for replacement gutters.

The structure of the gutter as shown in FIG. 1, together with the relatively simple mounting clips, 6, considerably simplify the installation and replacement of gutters. Once mounting clips, 6, are positioned and attached to framing structure, 3, (typically every 4 to 5 feet), the gutter, 1, can simply be snapped into position. No attention is required for "left" or "right" gutters, reducing the chances for installation errors and subsequent poor performance of the gutter, such as loosening and rapid distortion due to bowling ball impacts.

Once the gutter is snapped firmly into position using mounting clips 6, a capping clip, 7, is used to keep the gutter securely in place. Capping clip 7 is easily nailed or screwed onto the frame, 3 (using holes therein, 9, for such purpose) on the "cap side", opposite the "lane side" thereof as shown in FIG. 1.

Installation of replacement gutters is likewise considerably simplified by the present invention. Old gutters are removed by removing capping clip 7, snapping the gutter away from mounting clips, 6. New gutters (also, no attention being given to "left" or "right" gutters), are merely snapped into position in mounting clips, 6, and the capping clips, 7 are replaced. The vertical extent of the mounting clip, 6, along the outer edge thereof, 5, is typically 0.375 inches. This fits snugly into the opening of mounting clip, 6. Mounting clip, 6, is typically made of metal such that the upper portion thereof can be bent vertically upward for installation of the mounting structure 4. This temporary distortion of the upper portion of clip 6 serves to allow simple installation of the gutter, yet clamp securely in place atop the gutter for structural rigidity.

While many materials are candidates for bowling alley gutters, the present invention is typically manufactured with a metal gutter, coated by a vinyl laminate. It is found that this combination of vinyl coated metal gives a good combination of service life and fabrication simplicity.

We claim:

1. A bowling alley gutter comprising:

an elongate gutter having the general shape of a segment of a cylinder with a longitudinal axis thereof, and having a constant cross-sectional shape in a plane perpendicular to said longitudinal axis, wherein said cross-sectional shape in a plane perpendicular to said longitudinal axis, has a shape substantially similar to the arc of a circle, wherein said arc subtends an angle substantially equal to 117.3 degrees and wherein said circle has a radius substantially equal to 5.625 inches, further comprising at both circumferential termini of said arc, and integrally joined thereto, identically shaped acute angular segments, each subtending an angle substantially equal to 29 degrees, wherein one end of each of said angular segments joins one of said termini of said arc and the opposite end of said angular segments have a length of approximately 0.375 inches and lie on the opposite side of said arc from the center of said circle defining said arc, the resulting structure for said bowling alley gutter having mirror symmetry through a plane containing said longitudinal axis and bisecting said arc.

2. A bowling alley gutter as in claim 1 wherein said gutter is made of a metallic substrate having a vinyl coating securely laminated thereto.

3. In combination, a bowling alley gutter as in claim 1 combined with clips for securely mounting said gutter adjacent to a bowling alley; wherein the first of said clips, for use on the side of the framing structure adjacent to the bowling lane, comprises a vertical flat portion with at least one mounting hole therein, a curved upper portion fitting securely the angular end region of said gutter, and a substantially flat lower portion, the spacing between said upper and lower portions substantially equal to 0.375 inches; and wherein the second of said clips, for use on the side of the framing structure opposite said bowling lane, comprises a horizontal, substantially flat portion with at least one mounting hole therein and a curved end thereto securely fitting the angular end region of said gutter.

* * * * *